US005148581A

United States Patent [19]

Hartmann

[11] Patent Number: 5,148,581

[45] Date of Patent: Sep. 22, 1992

[54] CLIP DEVICE

[75] Inventor: Jerome Hartmann, Carlisle, Iowa

[73] Assignee: Cobbs Manufacturing Company, Des Moines, Iowa

[21] Appl. No.: 830,122

[22] Filed: Jan. 31, 1992

[51] Int. Cl.[5] ..... A44B 9/00; A47G 27/04

[52] U.S. Cl. ..... 24/351; 24/354; 24/511; 16/4

[58] Field of Search ..... 24/351, 352, 353, 354, 24/501, 511, 523, 562, 363; 16/4; 248/217.2

[56] References Cited

U.S. PATENT DOCUMENTS

| | | | |
|---|---|---|---|
| 382,480 | 5/1888 | Lines | 24/354 |
| 508,735 | 11/1893 | Miller | 24/354 |
| 580,975 | 4/1897 | Hanson | 16/4 |
| 590,876 | 9/1897 | Bliss, Jr. | 24/351 |
| 726,975 | 5/1903 | Neithercott | 24/351 |
| 1,226,540 | 5/1917 | Lauletta | 24/353 |
| 1,468,884 | 9/1923 | Schneider | 24/501 |
| 2,471,606 | 5/1949 | Burns | 24/511 |
| 4,425,690 | 1/1984 | Fraser et al. | 24/351 |
| 4,860,402 | 8/1989 | Dichtel | 16/4 |
| 5,075,935 | 12/1991 | Abdi | 24/511 |

FOREIGN PATENT DOCUMENTS

| | | | |
|---|---|---|---|
| 0965456 | 6/1957 | Fed. Rep. of Germany | 24/511 |
| 0005880 | of 1891 | United Kingdom | 24/351 |

OTHER PUBLICATIONS

Five photographs of various perspective views of a floor mat clip sold by Cobbs Manufacturing Co.

*Primary Examiner*—Victor N. Sakran
*Attorney, Agent, or Firm*—Dick and Harris

[57] ABSTRACT

A clip device for attaching an article and an adjacently positioned object in a predetermined orientation with respect to each other. A clamp which includes a first and second portion, is releasably maintained in a substantially closed orientation by a biased member. The clamp is pivotally mounted about a securement member. The securement member includes two substantially parallel positioned prongs which are insertable into the adjacently positioned object. The prongs each have an insertion tip, for initial insertion into the object, and an angled section located near the back end of the clamp. Extending at one angle between each prong and a region of the securement member about which the clamp is pivotally mounted is an extension section.

17 Claims, 1 Drawing Sheet

CLIP DEVICE

BACKGROUND OF THE INVENTION

1. Field of the Invention

This invention relates generally to clipping elements and more particularly to a clip device which can releasably maintain an article, such as a removable automobile floor mat in a relatively fixed position with respect to a stationary object, such as carpeting covering the floor boards in an automobile.

2. Background Art

Clips of the type primarily intended to secure an article, such as an automobile floor mat, to an object, such as carpeting which covers the floor boards in an automobile, have been known in the art for many years. While such clipping devices have primarily been intended to prevent, for example, automobile floor mats, from sliding around after being placed atop the carpeting on the floor, such clipping devices have been ineffective in maintaining such secured attachment during extended exposure to the constant forces which typically result from contact and movement caused from a person's feet. One example of such a prior art clip comprises a clamp element which is freely pivotally mounted about the bight portion of a generally planar U-shaped insertion member. The clamp is opened and closed by manual manipulation of a locking flap which operatively engages and cooperates with only the upper portion of the clamp.

In order to utilize the clip, a user must restrain the U-shaped insertion member, to preclude it from rotating into an undesired orientation, while simultaneously orientating the clamp so that its jaw section (the section opposite to where the clamp is pivotally mounted about the U-shaped insertion member) is adjacent to an end of the floor mat to be clamped. Two hands are generally used to actually open the jaws of the clip, one for opening the locking flap and the other for manually spreading apart the jaws of the clamp. Next, a user must hold the jaws open with one hand, while guiding the floor mat therebetween with the other hand. Once the floor mat is properly inserted, the locking flap must be forced closed, to in turn, "lock" the floor mat within the clamp. After the clamp is locked in place, the user must then insert the U-shaped insertion member into the underlying carpet.

Unfortunately, once secured to the carpet, the insertion member is not maintained in substantially parallel relationship to either the underlying carpet, or the clamp itself. Such non-parallel positioning contributes to the insertion member sliding out of the carpet after only a relatively short exposure to the forces exerted to the floor mat from a person's feet. Furthermore, inasmuch as the jaw portion of such prior art does not utilize angled gripping teeth, release of the floor mat from the clamp, even after being "locked" therein, also occurs after only limited exposure to such resultant foot forces.

SUMMARY OF THE INVENTION

The present invention is concerned with providing a clip device for use in releasably maintaining an otherwise non-secured article, such as an automobile floor mat, to a relatively stationary underlying object, such as carpeting or a rug which covers the floor boards of an automobile. Clamping means having a first and second portion are used for attachment of an article, such as an automobile floor mat. The first and second portions each include an article engagement side, an opposed side, a front end and a back end. Biasing means are operatively attached to the first and second portion of the clamping means for releasably maintaining the clamping means in a substantially closed orientation. The clamping means is mounted about securement means which are inserted in and secured to the underlying object (i.e. carpet). Gripping means, which may comprise a plurality of teeth-like elements that angle toward the back end of the clamping means, are integrally formed adjacent the front end of each of the first and second portions on their respective article engagement side.

The securement means includes a pivot attachment region about which the clamping means is pivotally mounted. In addition, the securement means includes two prong elements, each of which have chamfered insertion tips at one end, and an acute angled section adjacent the back end of the clamping means. The prongs are positioned in substantially parallel relationship to each other, and are positionable in a substantially parallel relationship to, and spaced a predetermined distance away from, an opposed side of one of the first and second portions of the clamping means. The distal positioning between the prongs and the opposed side of the first or second portion serves to compensate for the thickness of the underlying object (carpet) so as to reduce the likelihood of interference with the clamping means. The acute angle of each of the prongs forms a stop on insertion of the prongs and additionally enables a part of the underlying object to engage with the acute angle, as well as to be partially wedged therewithin, so as to help reduce inadvertent slippage, and accordingly release, of the prongs from the underlying object.

BRIEF DESCRIPTION OF THE DRAWINGS

For a better understanding of the present invention, reference may be had to the accompanying drawings in which.

DETAILED DESCRIPTION OF THE DRAWINGS

Figure 1:
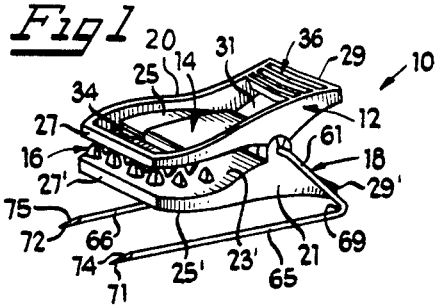
FIG. 1 is a perspective view of an embodiment of the present invention.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment illustrated.

Figure 7:
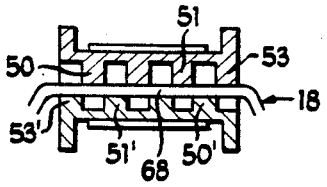
FIG. 7 is a fragmentary cross-sectional view taken generally along line 7—7 of FIG. 4 particularly showing the pivotal engagement of the first and second portions of the clamping means about attachment region of the securement member.
Figure 4:
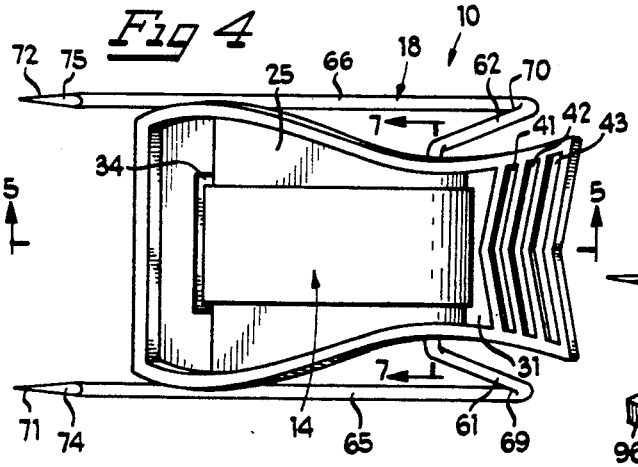
FIG. 4 is an enlarged scale, top plan view of the embodiment of the present invention.

Clip device 10 is shown in FIG. 1 as comprising clamping means 12, biasing means 14, gripping means 16 and object retention means including securement means 18. Clamping means 12 includes first portion 20 and second portion 21—both of which are substantially identical in construction. Accordingly, first and second portions each include article engagement side 23 and 23' (FIG. 5), an opposed side 25 and 25', front end 27 and 27', back end 29 and 29', aperture 31 and 31' (FIG. 6), and pivot attachment lobes, such as pivot attachment lobes 50, 50', 51, 51', 53, 53', as shown in detail in FIG. 7 and FIG. 8. As will be explained, these pivot attachment lobes intermesh with each other and are pivotally attached about pivot attachment region 68 (FIG. 8) of securement means 18. Article engagement side 23 and 23' of first and second portions 20 and 21, respectively, further include biasing means engagement slots 34 and 34' (FIG. 5), and slippage reducing means 36 and 36' (FIG. 5) which are operatively positioned adjacent back end 29, 29' of first and second portion 20, 21, respectively. The slippage reducing means each comprise a plurality of serrated sections 41, 41', 42, 42', 43, 43' (FIG. 4 and FIG. 5) which help prevent a user's finger(s) from slipping off of clamping means 12 while attaching same to an article—as will be explained in greater detail. Although three serrated sections having a "feather-like," or a "fish fin-like" configuration are shown, other types of configurations and types of non-slip surfaces, such as knurling, or high friction type material, are also contemplated.

Figure 2:
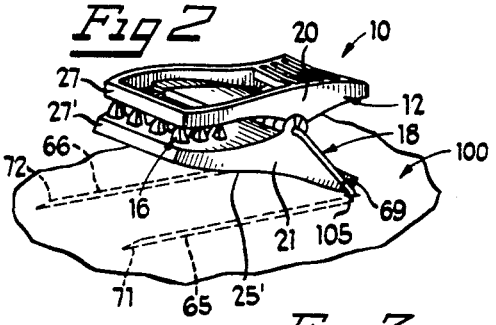
FIG. 2 is a perspective view of the embodiment of the present invention shown secured to a carpet.
Figure 3:
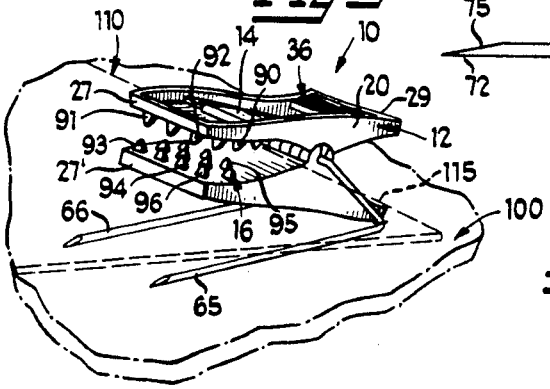
FIG. 3 i a perspective view of the embodiment of the present invention shown secured to a carpet and partially attached to floor mat which is shown in phantom.
Figure 8:
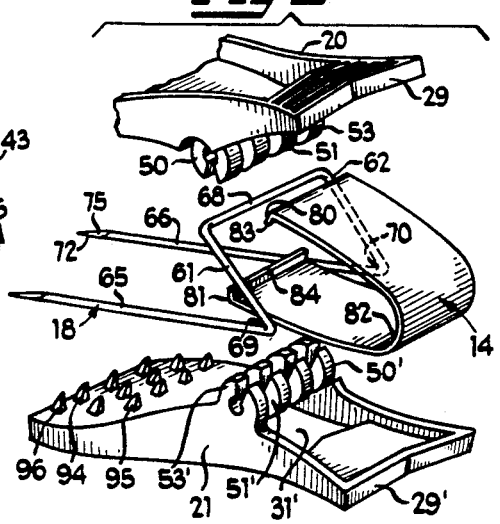
FIG. 8 is an enlarged scale exploded view of the embodiment of the present invention.

Securement means 18, which is preferably constructed as a single, substantially rigid member, is operatively configured to have a pivot attachment region 68, and two prongs 65 and 66 operatively and distally spaced below the pivot attachment region 68 in substantially parallel and planar relationship to each other (FIG. 8). As is more fully shown in FIG. 4, FIG. 6 and FIG. 8, prongs 65 and 66 are integrally formed with angled extension sections 61 and 62, respectively, which then extend at an angle into integrally formed pivot attachment region 68. As can be seen, each respective extension section and prong meet at an acute angle 69 and 70 therebetween. As will be explained in greater detail, acute angles 69 and 70 help to preclude the inadvertent release of prongs 65 and 66 from the object to which they are inserted. Prongs 65 and 66 additionally include insertion tips 71 and 72, respectively, each of which have chamfered ends 74 and 75, respectively. As can be seen in FIGS. 2 and 3, insertion tips 71 and 72 are the section of securement means 18, which are initially inserted into the object 100, with the chamfered ends facilitating such insertion.

Figure 5:
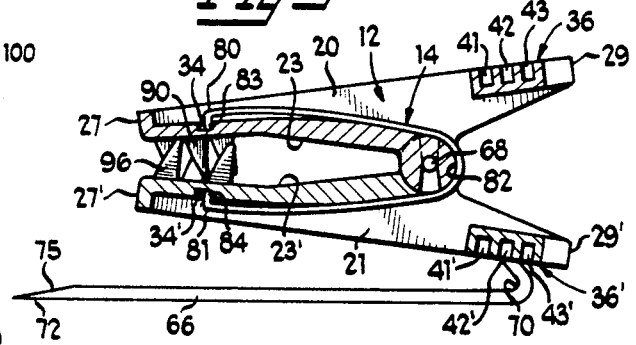
FIG. 5 is a cross-sectional view taken generally along line 5—5 of FIG. 4.
Figure 6:
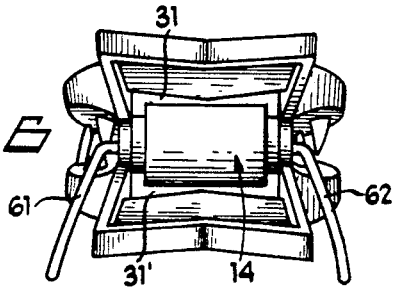
FIG. 6 is an enlarged scale rear elevational view of the embodiment of the present invention.

Biasing means 14, as shown more fully in FIGS. 5 and 8, preferably comprise a substantially U-shaped spring-clip— although other formations and types of biasing elements are also contemplated. Biasing means 14 includes top end 80, bottom end 81, and curved center region 82. Top and bottom ends 80 and 81 each comprise a bent tip, or angled projection, 83 and 84 respectively, which are bent towards each other for eventual insertion into a corresponding biasing means engagement slot 34 and 34' (FIG. 5). Such insertion is accomplished after pivoting lobes, such as pivoting lobes 50, 50', 51, 51', 53, 53', have been operatively intermeshed with each other about pivot attachment region 68 of securement means 18, and after top and bottom ends 80 and 81, respectively, of biasing means 14, are pushed through a corresponding aperture 31 and 31' (FIG. 6) of first and second portions 20 and 21, respectively, of clamping means 12, until curved center region 82 abuts with and about a section of the pivoting lobes. Once such abutment occurs, top and bottom ends 80 and 81, respectively, and more specifically, bent tips 83 and 84, will seat within a corresponding biasing engagement slot 34 and 34', to in turn, releasably maintain front ends 27 and 27' of first and second portions 20 and 21, respectively, of clamping means 12, in a substantially closed orientation. As will be explained in greater detail, opening the front end of the clamping means is accomplished by squeezing, or pressing, first and second portions 20 and 21, respectively, adjacent at least one of the back ends 29 and 29' at the slippage reducing means 36, 36', to in turn, temporarily overcome the compressing forces of biasing means 14.

Gripping means 16, as shown in FIGS. 1, 2, 3 and 5 comprise a plurality of teeth-like elements, such as teeth-like elements 90 through 96, which are integrally formed on article engagement side 23 and 23' of first and second portions 20 and 21 of clamping means 12. As can be seen more clearly in FIG. 5 and FIG. 8, each of the teeth-like elements have their free ends angled towards back end 29 and 29' of first and second portions 20 and 21, so as to increase their gripping capabilities to the article intended to be attached between the first and second portions of clamping means 12. Indeed, as shown in phantom in FIG. 3, the article, such as an automotive floor mat 110, will actually be sandwiched between the free ends of the teeth-like elements which will have at least partially pierced the area of the floor mat where contact between the floor mat and teeth-like elements have occurred.

Actual operation of clip device 10 will be explained with reference being primarily made to FIG. 2 and FIG. 3. As will become apparent, securement and attachment of clip device 10 is relatively simple and requires only single handed operation of the device itself. Furthermore, for illustration purposes only, reference will also be made to utilizing clip device 10 for securing an otherwise unattached automotive floor mat 110 (FIG. to carpet 100 (FIG. 2) which covers the floor boards in an automotive vehicle—although it should be noted that use of clip device 10 for purposes of attaching other types of articles to other types of underlying objects are also contemplated.

Clip device 10 will maintain automotive floor mat 110 to underlying carpet 100 after first grasping clip device 10 with one hand and then pivoting clamping means 12 so that front ends 27, 27' are positioned up and out of contact with at least a section of prongs 65 and 66. The user then pushes insertion tips 71 and 72 of prongs 65 and 66 into carpet 100, and continues pushing tips, and accordingly the prongs, forward, until the initially pierced section 105 of carpet 100 has been forced into engagement with acute angle, such as acute angle 69, of securement means 18. Such engagement, and, in turn, wedged positioning of section 105 of carpet 100, in acute angled region 69, reduces the likelihood of any inadvertent release of prongs 65 and 66 from carpet 100, after clamping means 12 has been operatively attached to automotive floor mat 110. To be sure, absent such an acute angle and the resulting substantially parallel alignment of opposed side 25' with prongs 65 and 66 after clamping means 12 has been attached to automotive floor mat 110, the prongs would readily, and inadvertently, slide out of carpet 100 merely from the external forces normally resulting from the weight and shuffling of a person's feet on the floor mat.

After securement means 18 has been fully inserted and accordingly secured to carpet 100, automotive floor mat 110 can then be attached between first and second portions 20 and 21, respectively of clamping means 12. Such attachment is accomplished by grasping automotive floor mat 110 with one hand, and then pressing serrated slippage reducing means 36 adjacent back end 29 of first portion 20 of clamping means 12, with the thumb or other part of the hand, downward towards carpet 100 (FIG. 3) until biasing means 14 has been overcome, and accordingly the front end of the clamping means has been forced open. Once open, the user simply slides an end portion 115 of the automotive floor mat between article engagement side 23 and 23' (FIG. 5), and in turn, between the free ends of the teeth-like elements integrally formed therewith, until edge 115 of automotive floor mat 110 has passed all of the teeth-like elements. The user then releases pressure on the clamping means so as to enable biasing means 14 to force first and second portions 20 and 21, respectively, and in turn, the free ends of the teeth-like elements, to close over the automotive floor mat. As previously explained, the angled positioning of the teeth-like elements, coupled with the force of the biasing member, substantially reduces the likelihood of any inadvertent release of the automotive floor mat from the article engagement side of the first and second portions of the clamping means, which could otherwise occur from forces exerted from shifting weight caused from contact with a person's feet. After the user has completely released physical contact with clip device 10, as well as the automotive floor mat, the weight of the released automotive floor mat will pull down the front end of clamping means 12 so that opposed side 25' of second portion 21 will be positioned in near parallel alignment with carpet 100. Although use and operation have been explained with respect to a "single handed" procedure, as well as with respect to inserting the securement means into the carpet prior to attachment of the clamping means to the automotive floor mat, two handed manipulation of clip device 10, as well as initial attachment of the clamping means to the automotive floor mat are also contemplated.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A clip device comprising:

clamping means having a first and second portion operatively aligned with each other for clamping an article therebetween, each of said first and second portions having an article engagement side, an opposed side opposite said article engagement side, a front end and a back end opposite said front end;

biasing means attached to said first and second portions of said clamping means for releasably maintaining said article engagement side of each of said first and second portions of said clamping means disposed to a substantially closed orientation;

one or more gripping means integrally formed with said article engagement side of each of said first and second portions for enhancing clamping of said article between said first and second portions of said clamping means; and securing means operatively attached to at least a part of said clamping means for securement to an object adjacent said article, said securing means includes two prong members integrally formed with said pivot attachment region, said members are in substantially parallel alignment to each other, as well as being positionable in substantially parallel alignment with said opposed side of one of said first and second portions of said clamping means prior to, and after, securement to said object, each of said prong members have insertion tips for facilitating initial insertion, and, in turn, securement of said securing means in and to said object, said securing means comprise retention means for substantially reducing the inadvertent release from said object said retention means including an acute angle between each of said prong members and said respective extension section proximate said back end of said first and second portions of said clamping means to form a stop on insertion of the prong members and so as to enable at least a part of said object to engage with said acute angle, to in turn, help preclude the inadvertent release of said securing means from said object.

2. The invention according to claim 1 in which said clamping means is pivotally mounted about a pivot attachment region of said securing means to as to enable pivotal adjustment of said clamping means relative to said securing means during attachment of said clamping means to said article.

3. The invention according to claim 1 in which each of said prong members are spaced from said pivot attachment region by a respective integrally formed extension section, such that said prong members are positionable in substantially parallel alignment with said opposed side of said one of said first and second portions of said clamping means a predetermined distance away from said opposed side of said one of said first and second portions of said clamping means.

4. The invention according to claim 1 in which said securing means comprise retention means for substantially reducing the inadvertent release from said object after said securing means have been operatively inserted and secured to said object, and, after said clamping means have been operatively attached to said adjacently positioned article.

5. The invention according to claim 1 in which each of said tips of said prong members are chamfered so as to facilitate insertion of said prong members into said object.

6. The invention according to claim 1 in which each of said tips of said prong members extend past said front end of said first and second portions of said clamping means.

7. The invention according to claim 1 in which:

the first and second portions of said clamping means further include an aperture positioned near said back ends of said first and second portions for allowing intercooperation with said biasing means;

said biasing means is generally U-shaped and has a first end and a second end; and said first end of said biasing means is inserted through and past said aperture in said first portion of said clamping means and said second end of said biasing means is inserted through and past said aperture in said second portion of said clamping means so as to releasably maintain said first and second portions of said clamping means in said substantially closed orientation.

8. The invention according to claim 7 in which:

each of said first and second portions of said clamping means further include slot means integrally formed within at least a section of said opposed side of same and positioned adjacent to said front end of said first and second portions, and said first and second ends of said biasing means each include angled projections for operative insertion into a corresponding one of said slot means, to in turn, help retain said biasing means in operative attachment with said clamping means.

9. The invention according to claim 1 in which said gripping means comprises a plurality of teeth-like elements operatively positioned adjacent said front end of each of said first and second portions of said clamping means for providing enhanced gripping capabilities, and in turn, enhanced attachment of said clamping means to said article.

10. The invention according to claim 9 in which:

said plurality of teeth-like elements are integrally formed on said article engagement side of each of said first and second portions of said clamping means; and each of said plurality of teeth-like elements of said first portion intermeshes with said plurality of teeth like-elements of said second portion when said clamping means is in said substantially closed orientation.

11. The invention according to claim 10 in which said teeth-like elements have free ends that are angled back towards said back end of each of said first and second portions of said clamping means to further enhance attachment to an article.

12. The invention according to claim 1 in which:

said clamping means further includes means to overcome said substantially closed orientation of said first and second portions of said clamping means caused by said biasing means, said overcoming means being operatively positioned proximate said back end of one or more of said first and second portions.

13. The invention according to claim 12 in which said overcoming means further includes means to reduce the likelihood of slippage of a user's fingers when attempting to overcome said biasing means.

14. The invention according to claim 13 wherein said slippage reducing means comprises one or more serrations operatively formed on said opposed side of at least one of said first and second portions of said clamping means.

15. A clip device comprising:

clamping means having a first and second portion operatively aligned with each other for clamping an article therebetween;

each of said first and second portions having an article engagement side, an opposed side opposite said article engagement side, a front end and a back end opposite said front end;

biasing means operatively attached to said clamping means for releasably maintaining said article engagement side of each of said first and second portions of said clamping means disposed to a substantially closed orientation;

one or more gripping means integrally formed with said article engagement side of each of said first and second portions for enhancing clamping of said article between said first and second portions of said clamping means;

object retention means comprising securing means operatively attached to at least a part of said clamping means for securement to an object adjacent said article;

said securing means including a pivot attachment region, two prong members integrally formed with, and distally spaced apart from, said pivot attachment regions by respective integrally formed extension sections;

said prong members being in substantially parallel alignment with each other as well as being positionable in substantially parallel alignment with said opposed side of one of said first and second portions of said clamping means; and each of said integrally formed extension sections being at an, acute angle to both the pivot attachment region and the respective prong member.

16. The invention according to claim 15 in which said object retention means comprises an acute angle between each of said prong members and said respective extension section proximate said back end of said first and second portions of said clamping means to form a stop on insertion of the prong members and so as to enable at least a part of said object to engage with said acute angle, to in turn, help preclude the inadvertent release of said securing means from said object.

17. The invention according to claim 15 in which:

each of said prong members have insertion tips for facilitating initial insertion, and, in turn, securement of said securing means in and to said object, each of said tips of said prong members are chamfered so as to facilitate insertion of said prong members into said object, and each of said tips of said prong members extend past said front end of said first and second portions of said clamping means.

* * * * *

UNITED STATES PATENT AND TRADEMARK OFFICE

CERTIFICATE OF CORRECTION

PATENT NO. : 5,148,581

DATED : September 22, 1992

INVENTOR(S) : Jerome Hartmann

It is certified that error appears in the above-identified patent and that said Letters Patent is hereby corrected as shown below:

| | |
|---|---|
| Column 2, Line 46 | Delete "i" and instead insert --is--. |
| Column 2, Line 48 | After "attached to" insert --an automotive--. |
| Column 2, Line 58 | After "about" insert --the pivot--. |
| Column 4, Line 45 | Delete "(FIG." and instead insert --(FIG. 3)--. |
| Column 6, Line 23 | After "object" insert --,--. |
| Column 6, Line 34 | After "means" delete "to" and instead insert --so--. |
| Column 8, Line 36 | After "an" delete ",". |

Signed and Sealed this

Twenty-sixth Day of October, 1993

*Attest:*

Bruce Lehman

BRUCE LEHMAN

*Attesting Officer*

*Commissioner of Patents and Trademarks*